US006779275B2

(12) United States Patent
Tsaur

(10) Patent No.: US 6,779,275 B2
(45) Date of Patent: Aug. 24, 2004

(54) COTTON SWAB LINE MARKING MEANS

(76) Inventor: Garry Tsaur, 19222 Tranbarger St., Rowland Heights, CA (US) 91748

( * ) Notice: Subject to any disclaimer, the term of this patent is extended or adjusted under 35 U.S.C. 154(b) by 0 days.

(21) Appl. No.: 10/106,612

(22) Filed: Mar. 26, 2002

(65) Prior Publication Data

US 2003/0182812 A1 Oct. 2, 2003

(51) Int. Cl.[7] ..... B41G 3/00
(52) U.S. Cl. ..... 33/34; 33/413; 101/35
(58) Field of Search ..... 33/34, 18.1, 21.1, 33/21.2, 26, 32.1, 32.2, 32.5, 413, 32.6, 414; 101/35, 38.1, 39, 327, 333

(56) References Cited

U.S. PATENT DOCUMENTS

| | | | | | |
|---|---|---|---|---|---|
| 425,834 | A | * | 4/1890 | Sword | 118/268 |
| 733,491 | A | * | 7/1903 | Litchfield | 118/268 |
| 785,198 | A | * | 3/1905 | Chirac | 101/39 |
| 1,390,926 | A | * | 9/1921 | Reach | 101/7 |
| 1,976,288 | A | * | 10/1934 | Ludewigs | 101/333 |
| 2,067,447 | A | * | 1/1937 | Hommel | 118/219 |
| 2,288,015 | A | * | 6/1942 | Mumma | 101/327 |
| 2,620,499 | A | * | 12/1952 | Dressel | 401/119 |
| 3,368,482 | A | * | 2/1968 | Lusher et al. | 101/153 |
| 3,641,934 | A | * | 2/1972 | Rudolf | 101/333 |
| 3,669,071 | A | * | 6/1972 | Gates | 118/264 |
| 3,678,848 | A | * | 7/1972 | Roser et al. | 101/125 |
| 4,058,085 | A | * | 11/1977 | Yang | 118/264 |
| 4,531,475 | A | * | 7/1985 | Thill | 118/503 |
| 4,614,163 | A | * | 9/1986 | Hetzer et al. | 118/268 |
| 5,829,350 | A | * | 11/1998 | Muchi et al. | 101/35 |

* cited by examiner

*Primary Examiner*—Christopher W. Fulton
*Assistant Examiner*—Amy R. Cohen
(74) *Attorney, Agent, or Firm*—Joe Nieh

(57) ABSTRACT

A means is disclosed for marking one or more clean line on the absorbent tip of a cotton swab. The means comprises of a tool with a thin groove wherein at predetermined locations at the bottom of the thin groove, there are channels for directing ink into the thin groove from an ink source. A thin absorbent thread is placed into this thin groove to absorb and distribute the ink thereby allowing controlled distribution of the ink which results in the formation of a clean line when the absorbent tip of a cotton swab is rotated over the thin absorbent thread during the manufacturing of the cotton swab resulting in a clean line marked on the absorbent tip.

8 Claims, 2 Drawing Sheets

COTTON SWAB LINE MARKING MEANS

BACKGROUND-FIELD OF INVENTION

The present invention relates to a line marking means for marking one or more clean line on the absorbent tip of a cotton swab.

BACKGROUND-DESCRIPTION OF RELATED ART

Cotton swabs with one or more absorbent tips are commonly used in households for cleaning ears, nose, wounds, small appliances, and for a variety of other applications. The absorbent tip on the cotton swab may be made of cotton, sponge, or any absorbent material. Generally, the absorbent tip is white in color with an elliptical profile and surrounds the cotton swab tube symmetrically.

Various designs exist for differentiating one cotton swab from another. Some designs use different color cotton swab tubes. Generally, the tubes in these designs are made of plastic. Other designs use different color absorbent tips. The color absorbent tips on these designs can only have one color. If more colors are used the colors will blend into each other at their intersections and result in a blur of colors due to the absorbent property of the absorbent tip. Also, the tip may not have any designs such as a simple clean line on it. Many have attempted to mark lines on the absorbent tip and failed. Attempts to mark a clean line on the absorbent tip have resulted in a blurred line that will simply spread into the surrounding material due to the absorbent property of the absorbent tip. Marking a clean line on the absorbent tip of the cotton swab has been virtually impossible.

SUMMARY OF THE INVENTION

The present invention is a means for marking one or more clean line on the absorbent tip of a cotton swab which had been virtually impossible to do prior to the present invention. The present invention comprises of a tool with a thin groove wherein at predetermined locations at the bottom of the thin groove, there are channels for directing ink into the thin groove from an ink source. A thin absorbent thread is placed into this thin groove to absorb and distribute the ink thereby allowing controlled distribution of the ink which results in the formation of a clean line when the absorbent tip of a cotton swab is rotated over the thin absorbent thread during the manufacturing of the cotton swab resulting in a clean line marked on the absorbent tip.

DETAILED DESCRIPTION OF THE PREFERRED EMBODIMENT

Figure 1:
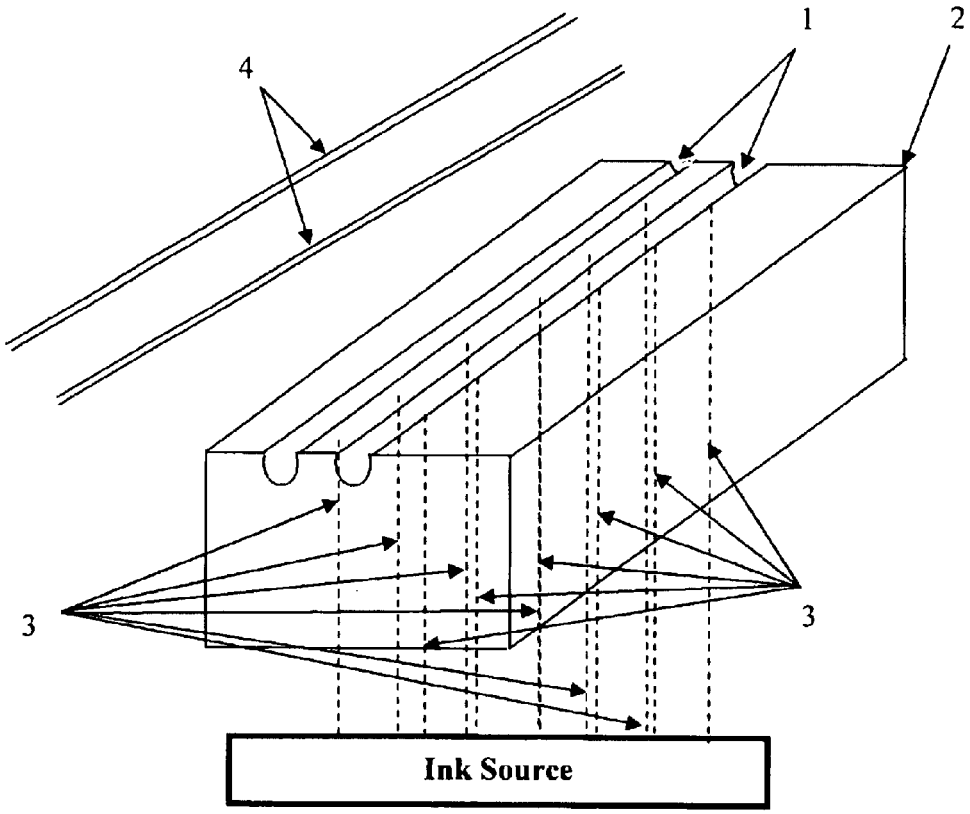
FIG. 1 shows the preferred embodiment of the means for marking a clean line on the absorbent tip of a cotton swab.

FIG. 1 shows the preferred embodiment of the cotton swab line marking means. A thin groove 1 is formed in a tool 2. At predetermined locations at the bottom of the thin groove 1 are channels 3 for directing ink from an ink source to the thin groove 1. An absorbent thread 4 of suitable thickness is placed into the thin groove 1 to absorb and distribute the ink in the thin groove 1. The absorbent thread 4 will absorb the ink from the channels 3 and distribute the ink evenly over the length of the absorbent thread 4.

The absorbent tip of the cotton swab is rotated across the length of the absorbent thread 4 to mark a clean line around the absorbent tip. The absorbent thread 4 will control the absorption rate of the ink into the absorbent tip such that the ink line will not spread into a blurred line.

Figure 2:
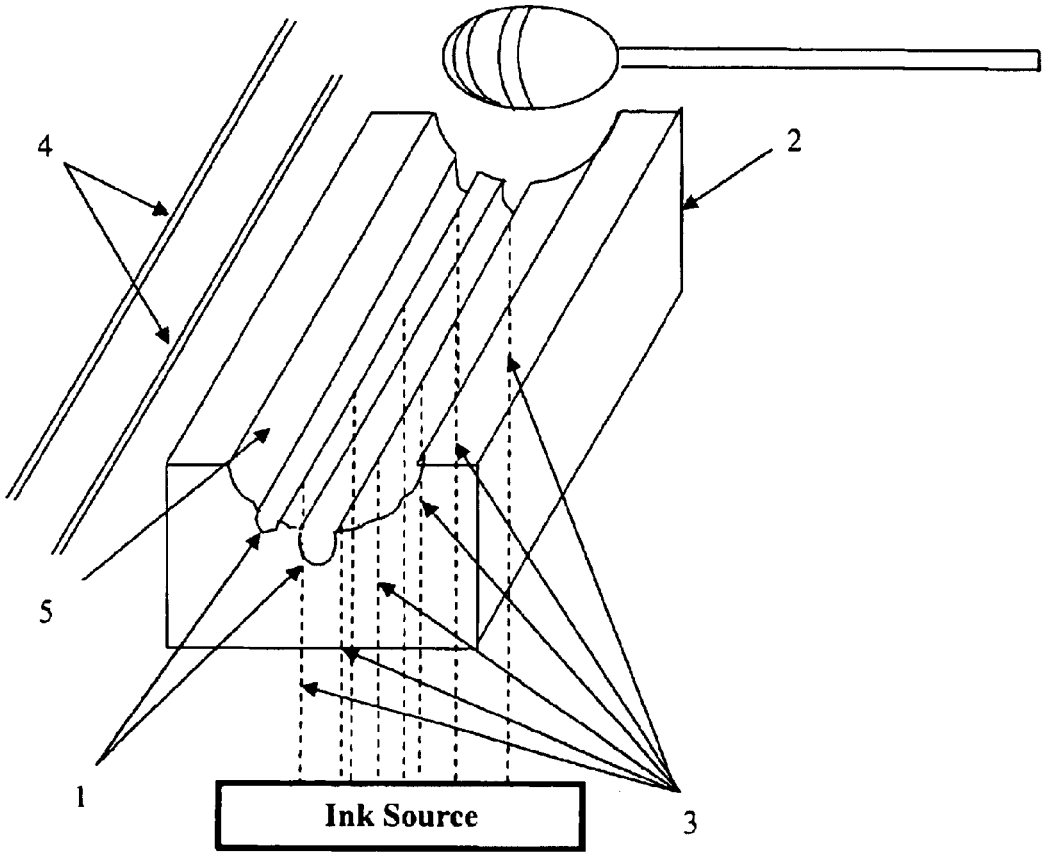
FIG. 2 shows another embodiment of the means for marking a clean line on the absorbent tip of a cotton swab wherein the cotton swab line marking means is used in conjunction with and during the formation of the absorbent tip of the cotton swab.

FIG. 2 shows another embodiment of the means for marking a clean line on the absorbent tip of a cotton swab wherein the cotton swab line marking means is used in conjunction with and during the formation of the absorbent tip of the cotton swab.

A predetermined profile 5 is formed in a tool 2 to shape the profile of the absorbent tip of the cotton swab. A thin groove 1 is formed at a predetermined location on the wall of the predetermined profile 5 in the tool 2. At predetermined locations at the bottom of the thin groove 1 are channels 3 for directing ink from an ink source to the thin groove 1. An absorbent thread 4 of suitable thickness is placed into the thin groove 1 to absorb and distribute the ink in the thin groove 1. The absorbent thread 4 will absorb the ink from the channels 3 and distribute the ink evenly over the length of the absorbent thread 4.

An unformed absorbent tip of the cotton swab is rotated across the length of the tool 2. The unformed absorbent tip will be formed into the shape of the predetermined profile 5. After the absorbent tip of the cotton swab is rotated across the length of the absorbent thread 4, a clean line is marked around the absorbent tip. The absorbent thread 4 will control the absorption rate of the ink into the absorbent tip such that the ink line will not spread into a blurred line.

Although the description above contains many specificities, these should not be construed as limiting the scope of the invention but as merely providing illustrations of some of the presently preferred embodiments of this invention. For example, more than one groove may be formed in the tool with an absorbent thread in each groove to mark multiple clean lines around the absorbent tip. Thus the scope of the invention should be determined by the appended claims and their legal equivalents, rather than by the examples given.

What is claimed is:

1. A cotton swab line marking device comprising:

one or more grooves formed in a tool;

one or more channels at predetermined locations in the tool for directing ink from an ink source into the one or more grooves in the tool; and one or more absorbent threads of suitable thickness placed in each of the grooves in the tool;

wherein the one or more absorbent threads will absorb and distribute the ink entering into the one or more grooves from the one or more channels such that when an absorbent tip of a cotton swab is rotated across the length of the one or more absorbent threads one or more clean lines is marked on the absorbent tip.

2. A cotton swab line marking device as in claim 1, wherein the groove is a thin groove.

3. A cotton swab line marking device as in claim 1, wherein the absorbent thread is a thin cotton thread.

4. A cotton swab line marking device as in claim 2, wherein the absorbent thread is a thin cotton thread.

5. A cotton swab line marking device comprising:

a tool with a predetermined profile for shaping an unformed absorbent tip of a cotton swab;

one or more grooves formed in the tool;

one or more channels at predetermined locations in the tool for directing ink from an ink source into the one or more grooves in the tool; and one or more absorbent threads of suitable thickness is place in each of the grooves in the tool;

wherein when the unformed absorbent tip of the cotton swab is rotated through the length of the tool the absorbent tip will be formed into the shape of the predetermined profile of the tool and wherein the one or more absorbent threads will absorb and distribute the ink entering into the one or more grooves from the one or more channels such that one or more clean lines is marked on the absorbent tip.

6. A cotton swab line marking device as in claim 5, wherein the groove is a thin groove.

7. A cotton swab line marking device as in claim 5, wherein the absorbent thread is a thin cotton thread.

8. A cotton swab line marking device as in claim 6, wherein the absorbent thread is a thin cotton thread.

* * * * *